United States Patent [19]

Contractor et al.

[11] 4,024,612

[45] May 24, 1977

[54] PROCESS FOR MAKING AN APERTURED NONWOVEN FABRIC

[75] Inventors: Rashmikant Maganlal Contractor, Wilmington; Birol Kirayoglu, Newark, both of Del.

[73] Assignee: E. I. Du Pont de Nemours and Company, Wilmington, Del.

[22] Filed: Apr. 2, 1976

[21] Appl. No.: 673,343

[52] U.S. Cl. ..... 28/72.2 F; 19/161 P

[51] Int. Cl.[2] ..... D04H 18/00; D04H 5/02

[58] Field of Search ..... 28/4 R, 72.2 F; 19/161 R, 161 P; 428/134, 227, 234, 280, 281, 340

[56] References Cited

UNITED STATES PATENTS 3,485,706 12/1969 Evans ..... 19/161 R

*Primary Examiner*—Louis K. Rimrodt

[57] ABSTRACT

The tensile strength of apertured nonwoven fabric can be increased by a change in the two-stage process of impinging fine columnar streams of liquid, first onto one face of a fibrous web and then onto the opposite face thereof, the change being that the asymmetrical woven wire screen on which the web is positioned during the second stage of the process is oriented with the wire forming the higher knuckle in the screen running in the direction of passage of the web beneath the fine columnar streams, with the area weight of the web being from 0.5 to 2.0 oz/yd$^2$.

5 Claims, 3 Drawing Figures

PROCESS FOR MAKING AN APERTURED NONWOVEN FABRIC

BACKGROUND OF THE INVENTION

This invention relates to an improved process for making an apertured nonwoven fabric from a fibrous web.

U.S. Pat. No. 3,485,706 disclosed the basic process of impinging fine columnar streams onto a fibrous web supported on an apertured support to convert the web by fiber entanglement into an apertured nonwoven fabric. The apertures in the fabric correspond to solid portions of the apertures support on which the fibrous web is positioned during the impingement process. When the apertured support is a woven wire screen, the apertures in the fabric correspond to knuckles in the screen. Among the possibilities for operation disclosed in this patent is the posibility of using a woven-wire screen such as shown in FIG. 14 of the patent wherein the screen is asymmetrical in the sense that the wires running in one direction have a greater crimp and thereby form a higher knuckle than the wires running in the transverse direction. Other types of screens are shown in FIGS. 20–23 of the patent.

Another possibility for operation is to carry out the impingement step using equipment such as shown in FIG. 1 of the patent first in one direction on one face of the web and then in the transverse direction of the same face of the web to form the fabric.

Another possibility as shown in FIG. 2 of the patent is to carry out the impingement step using a series of banks of fine columnar streams exerting increasing impact force on only a single face of the web to form the fabric. In this single stage treatment it was found that using an asymmetrical woven-wire screen with the wires forming the higher knuckles running in the cross (transverse) direction of passage of the web beneath the streams of liquid increased the tensile strength of the resultant fabric. Still another possibility as shown in FIG. 40 of the patent is to carry out the impingement step in two stages, first on one face of the fibrous web and then on the opposite face of the fibrous web.

The two-stage impingement process has been operated using as the apertured support for the web in the second stage an asymmetrical woven-wire screen wherein the wires forming the higher knuckle run in the cross direction relative to the direction of passage of the fibrous web beneath the fine columnar streams of liquid. In this process, the apertures in the fabric correspond at least to the higher knuckles in the screen. For very low area weight webs such as 0.8 oz/yd$^2$ (27.1 g/m$^2$), there may be additional aperatures in the resultant fabric corresponding to the lower knuckles formed by the transverse wires of the screen. In this specific process, the desire arose to increase efficiency of operation, i.e., to increase the strength of the fabric without using more liquid; or to get the same strength in the fabric by using less liquid; or to get equivalent strength using a lower area weight web, which would lead to an increase in the rate of production of the web.

SUMMARY OF THE INVENTION

It has beed discovered that the efficiency of the specific two-stage impingement process hereinbefore described can be improved by (a) orienting the screen in the second stage so that the wires forming the higher knuckles in the screen run in the direction of passage of the fibrous web beneath the fine columnar streams and (b) selecting the proper light weight fibrous web for which a fabric of improved strength is obtained with this screen orientation.

More specifically, the process of the present invention arises in the process of impinging fine columnar streams of liquid first onto one face of a fibrous web on an apertured support passing beneath said streams and then onto the opposite face of said web on an asymmetrical woven-wire screen passing beneath said streams to produce by fiber entanglement an apertured nonwoven fabric wherein the apertures in said fabric correspond to knuckles in said screen, and provides the improvement comprising carrying out the impingement of said fine columnar streams onto said opposite face of said web wherein the wires forming the higher knuckles in said screen run in the direction of passage of said web beneath said streams and obtaining as a result thereof an apertured nonwoven fabric of increased tensile strength.

The area weight of the web is selected in a light weight range so as to obtain this increased strength as ccompared to when the screen is oriented with the higher knuckle wires running in he transverse direction to the direction of passage of the web beneath the streams. Generally, the strength improvement decreases with increasing web area weight. However, under some conditions of operation, a small improvement is found at web area weights as high as 2.0 oz/yd$^2$ (67.8 g/m$^2$). Preferably, however, the web area weight will be selected from the range of 0.5 to 1.7 oz/yd$^2$ (17 to 67.7 g/m$^2$).

BRIEF DESCRIPTION OF THE DRAWINGS

The present invention will be described in greater detail hereinafter with reference to the drawing in which.

DETAILED DESCRIPTION OF THE INVENTION

The two-stage impingement process for making an apertured nonwoven fabric in which context the present invention arises can be conducted in a continuous in-line operation by passing the fibrous web over a drum for the first stage of impingement by fine columnar streams of liquid onto one face of the web and then passing the fibrous web onto another drum for the second stage of impingement of the streams onto the opposite face of the fibrous web, as shown in FIG. 40 of U.S. Pat. No. 3,485,706.

Figure 1:
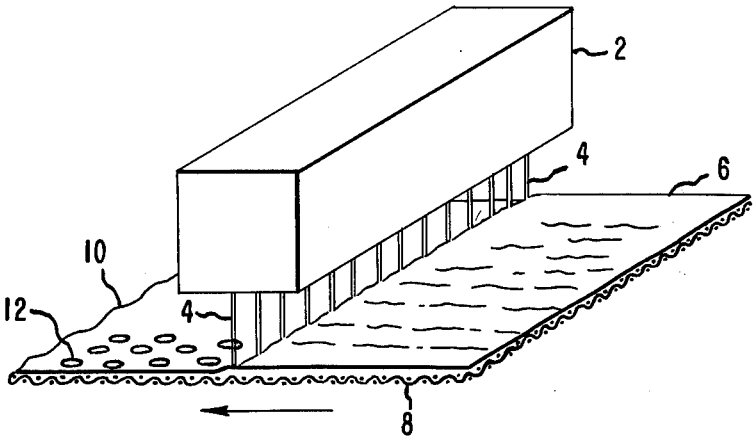
FIG. 1 shows schematically and in perspective the impingement of fine columnar streams of liquid onto a fibrous web on an apertured support to form an apertured nonwoven fabric in accordance with the process of the present invention.

The present invention is concerned with the second stage of impingement. FIG. 1 shows a representative embodiment for carrying out this second stage. More specifically, FIG. 1 shows a manifold bank 2, to which liquid under high pressure is fed (by means not shown) and issues as a series of fine columnar streams 4 of the liquid. These streams impinge on a fibrous web 6 on an asymmetrical woven-wire screen 8 passing therebeneath in the direction indicated. The impingement of the streams 4 on the web 6 converts the fibrous web by fiber entannglement into a nonwoven fabric 10 having apertures 12 therein. A series of banks 2 can be used particularly for the purpose of stepwise increasing the impact force of the fine columnar streams onto the fibrous web, and such series of banks can be spaced about the circumference of a drum, wherein the screen 8 is on the surface of the drum, such as shown in FIG. 40 of U.S. Pat. No. 3,485,706.

Figure 2:
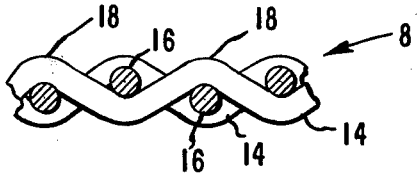
FIG. 2 shows in enlargement, a side view of a length of asymmetrical woven-wire screen.

In accordance with the present invention, the wires forming the higher knuckles in the asymetrical screen 8 as compared to the transverse wires in the screen run in the direction of passage of the fibrous web 6 beneath the fine columnar streams 4. FIG. 2 shows a screen 8 consisting of a highly crimped wire 14 interweaving with transverse wire 16 only the ends of which are visible. The high crimp off the wire 14 as it passes over the top of a transverse wire 16 forms knuckles 18 which are the higher knuckles in the screen.

Figure 3:
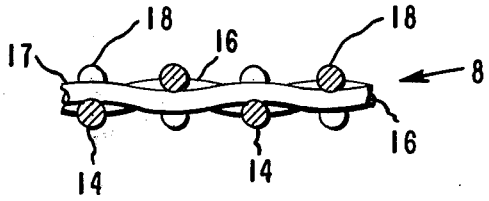
FIG. 3 shows an end view of the screen of FIG. 2.

FIG. 3 shows the transverse wire 16 direction of the screen 8 wherein the transverse wire 16 interweaves with much less crimp with the wire 14 and consequently forms lower knuckles 17 than knuckls 18.

The wires such as wire 14 forming the higher knuckles in the screen as compared to the transverse wire 16 in the screen run in the direction of the arrow shown in FIG. 1 beneath the fine columnar streams. The lesser crimped transverse wires such as wire 16 run in the cross direction relative to the direction of passage of the web beneath the fine columnar streams.

The apertures 12 in the apertured nonwoven fabric 10 are formed at locations corresponding to the knuckles 18 in the screen 8.

In addition to the screen orientation just described, the present invention requires selection of the area weight of the fibrous web that will show improvement in results. More particularly, the improvement arising from the change in screen orientation according to the present invention only seems to arise when the web is a lightweight web, and the particular range of web area weight at which the improved strength will be obtained will depend on such operating conditions as the particular screen size of the asymmetrical screen and on characteristics of the fibrous web, e.g., fiber identity, denier, and staple length. The screens will have a mesh size of 4–60 mesh (2–24 wires/cm) at least in one direction of the screen. Screens may have a higher mesh size in the transverse direction and still provide an apertured fabric. The most preferred range of area weight of the fibrous web is from 0.7 to 1.3 oz/yd$^2$ (23.7 to 44.1 g/m$^2$), with the particular area weight within this range being selected to give the strength increase by the screen orientation according to the present invention. The difference in knuckle height between the machine direction and transverse wires required will depend on the mesh size of the screen and diameter of the wires. The screens considered asymmetrical by screen manufacturers can be used in this invention.

Surprisingly, when the two-stage impingement process is run with the asymmetrical screen oriented in the second state in the manner just described and using the proper lightweight web, the resultant aperture nonwoven fabric has increased tensile strength as compared to when the screen is oriented with the lower knuckle wires 16 running in the direction of passage of the fibrous web the fine columnar streams.

Further details on the operation of the process of the present invention, e.g., the fibrous web starting material, the impingement treatments in the two stages, and the resultant fabric are disclosed in U.S. Pat. No. 3,485,706. By way of summary, the streams of liquid are substantially non-diverging, hence their being called columnar streams. They have a divergence angle measured at the stream orifice of less then 5°, preferably less than 3° and more preferably less than 1°. The stream orifices are fine in the sense that their orifices preferably have a diameter of from 3 to 10 mils (0.0762 to 0.254 mm). The preferred liquid is water, and this water may contain an additive such as a wetting or lubricating agent. The streams are spaced as close together as possible without interfering with one another on their way to impinging on the fibrous web. The particular spacing, however, will depend on the size of the orifice. Generally, the spacing will be at least 20 stream orifices per inch (7.9/cm) and preferably at least 30 stream orifices/inch (11.8/cm) across the width of the fibrous web.

The pressure on the liquid within manifold 2 is generally at least 14 kg/cm$^2$ gauge, and the impact pressure of the fine columnar streams on the web is generally at least 23,000 foot-poundals/in$^2$ sec (9000 joules/cm$^2$ min) to provide a total energy of impingement from both stages of the impingement process of at least about 0.1 HP-hr/lb (0.14 Kcal/gm) of fabric. Usually liquid pressures greater than 140 kg/cm$^2$ gauge will be unnecessary.

The energy of impingement by the fine columnar streams of liquid is divided between the two stages in such a way that each face of the fabric receives sufficient impingement to obtain the surface stability desired. By surface stability is meant qualitatively that the web is resistant to pilling or fuzzing, which resistance is achieved by the fiber entanglement caused by the impingement, which also supplies the strength to the fabric. Generally, the first stage provides from 20 to 80% of the total energy of impingement. The second stage of impingement provides the remainder of the energy of impingement of the process, and surface stability to the opposite face of the fabric. Preferably, the apertured support for the fibrous web used in the first stage of impingement is a sufficiently fine mesh screen that such the screen does not impart any pattern of apertures to the fibrous web in the first stage of impingement for the particular area weight web and impingement energy used. Such apertured support will generally be at least 60 mesh (23.6 wires/cm) and finer in both directions in the screen. In the second stage, the asymmetrical woven-wire screen support oriented in the manner of the present invention provides the pattern of apertures in the fabric. In this preferred embodiment, the proportion of the total impingement energy used in the first stage should not be that formation of the apertured pattern in the fabric is prevented in the second stage. Thus, preferably no more than 60% of the total impingement energy is used in the first stage.

Examples of fibrous webs that can be used in the present invention are carded or random webs of staple fibers of naturally occurring materials such as cotton or synthetic material, such as polyamide, polyester, and rayon.

The apertured nonwoven fabric produced by the process of the present invention is characterized in the same way as in U.S. Pat. No. 3,485,706, i.e., by dense fiber entangled regions in which the fiber entanglement is three-dimensional, i.e., the fibers run and are entangled through the thickness of the fabric. The fiber entangled regions are interconnected by groups of fibers, and the fiber entangled regions together with the interconnected fiber groups define the apertures of the fabric. The fiber entangled regions in the fabric correspond to the apertures in the asymmetrical screen.

The process of this invention is illustrated by the following Examples (water pressures are gauge pressures):

EXAMPLE 1

General Procedure:

A series of air-laid webs of randomly dispersed poly(ethylene terephthalate) staple fibers, having a denier per filament of 1.25 and a length of 0.75 inch (1.9 cm), is prepared. The webs differ in area weight from a nominal weight of about 1 oz/yd² (33.9 g/m²) to a nominal weight of about 1.5 oz/yd² (50.9 g/m²). Each web is subjected to the two-stage impingement process with the same total impingement energy amounting to 40% in the first stage and 60% in the second stage.

In the first stage of the process, each web is supported on a screen having 100 × 96 wires/inch (39.4 × 37.8 wires/cm). The web is then impinged with fine columnar streams of water by passing the web on its screen under a manifold containing a single row of 5 mil diameter (0.127 mm) orifices spaced 40 orifices/inch (15.7/cm) across the entire width of the web. The web is passed under the orifices at a web-to-orifice separation of one inch (2.54 cm) under the following pressure conditions (gauge) on the liquid streams issuing from the orifices:

First Pass: 400 psi (29 kg/cm²)
Second Pass: 700 psi (49 kg/cm²)
Third & Fourth Passes: 1700 psi (119 kg/cm²).

The mesh of the first screen is sufficiently fine that the web is entangled by the treatment but is not arranged into a pattern of apertures.

In the second stage of the process, the web is positioned so that its previously treated face is adjacent an asymmetrical woven-wire screen. Different such screens are used as described in Table I.

TABLE I

Screens Used in Second Stage of Impingement Process

| Screen No. | Screen Weave | Warp Wires (No. per in.) | Warp Wires (No. per cm.) | Shute Wires (No. per in.) | Shute Wires (No. per cm.) | Major Crimp Wire | % Open Area[1] |
|---|---|---|---|---|---|---|---|
| 1 | Plain, flat warp wire | 24 | 9.5 | 24 | 9.5 | Warp | 21 |
| 2 | Plain, oblong | 50 | 19.7 | 38 | 15.0 | Warp | 30 |
| 3 | Plain, oblong | 8 | 3.2 | 28 | 11.0 | Shute | 16 |
| 4 | Plain, Dutch | 12 | 4.7 | 64 | 25.2 | Shute | 0 |
| 5 | Twill | 40 | 15.7 | 40 | 15.7 | Warp | 21 |
| 6 | Semi-twill, flat warp | 50 | 19.7 | 48 | 18.9 | Warp | 20 |

[1]% open area is calculated from the expression
[1−(warp wire frequency × warp wire dia)] × [1−(shute wire frequency × shute wire dia)] × 100
Zero % open area means that no open area is visible in the plan view of the screen; the screen does have openings, however, in sideways paths between the interwoven warp and shute wires.

The web-to-orifice spacing and the orifices are the same as used in the first stage except that the last pass in the second stage is beneath the same orifices spaced 24/cm. The following pressure conditions (gauge) are used:

First Pass: 500 psi (35 kg/cm²)
Second Pass: 1700 psi (119 kg/cm²)
Last Pass: 1800 psi (126 kg/cm²).

Web speed under the manifolds is adjusted for each web weight in order to achieve equivalent treatment, as follows:

| | | | | |
|---|---|---|---|---|
| Web Nominal Weight | (oz.yd²): | 1 | 1.5 | 2.0 |
| Web Nominal Weight | (g/m²): | 33.9 | 50.9 | 67.8 |
| Web speed | (ypm): | 33 | 22 | 15 |
| Web speed | (m/min): | 30.2 | 20.1 | 13.7 |

After treatment, each web is removed from its screen, dried at room temperature, and then tested for strip tensile strength.

Results

In one series of experiments using the foregoing-described general procedure, the screen was oriented in the second stage of impingement with the higher knuckle (major crimp) wires running in the direction of passage of the web under the jets, i.e., machine direction (MD). In a second series of experiments not according to the present invention, the screen was oriented in the second stage of impingement with the higher knuckle wires running in the cross direction (XD) of the machine under the jets. Properties of the resultant nonwoven fabrics obtained are reported in Table II.

The fine columnar streams of water used in all the passes in the first and second stages of impingement treatment of the web had a divergence angle of less than 1° and impinged on the web as a solid stream of water.

TABLE II

Properties of Nonwoven Fabrics According to First Series of Experiments and to Second (Comparison) Series of Experiments

| Stage 2 Screen | Nominal Web Weight (oz/yd²) | Nominal Web Weight (g/m²) | Strip Tensile Strength of Nonwoven Fabric: Major Crimp MD (Invention) MD (g/cm per g/m²) | Major Crimp MD (Invention) XD (g/cm per g/m²) | Major Crimp MD (Invention) Sum of MD + XD | Major Crimp XD (Comparison) MD (g/cm per g/m²) | Major Crimp XD (Comparison) XD (g/cm per g/m²) | Major Crimp XD (Comparison) Sum of MD + XD |
|---|---|---|---|---|---|---|---|---|
| 1 | 1.0 | 33.9 | 22.0 | 20.9 | 42.9 | 14.6 | 17.5 | 32.1 |
| | 1.5 | 50.9 | 36.2 | 29.5 | 65.7 | 37.8 | 31.4 | 69.2 |
| | 2.0 | 67.8 | 45.5 | 50.6 | 96.1 | 48.6 | 49.1 | 97.7 |
| 2 | 1.0 | 33.9 | 33.8 | 30.0 | 63.8 | 19.7 | 17.0 | 36.7 |
| | 1.5 | 50.9 | 43.2 | 38.6 | 81.8 | 38.4 | 31.0 | 69.4 |
| | 2.0 | 67.8 | 53.4 | 47.1 | 100.5 | 54.3 | 48.8 | 103.1 |
| 3 | 1.0 | 33.9 | 28.4 | 33.7 | 62.1 | 18.6 | 15.7 | 34.3 |
| | 1.5 | 50.9 | 41.3 | 39.3 | 80.6 | 36.3 | 36.1 | 72.4 |
| | 2.0 | 67.8 | 50.4 | 52.3 | 102.7 | 48.9 | 47.7 | 96.6 |

TABLE II-continued

Properties of Nonwoven Fabrics According to First Series of Experiments and to Second (Comparison) Series of Experiments

| Stage 2 Screen | Nominal Web Weight (oz/yd²) | Nominal Web Weight (g/m²) | Strip Tensile Strength of Nonwoven Fabric: Major Crimp MD (Invention) MD (g/cm per g/m²) | Major Crimp MD (Invention) XD (g/cm per g/m²) | Major Crimp MD (Invention) Sum of MD + XD | Major Crimp XD (Comparison) MD (g/cm per g/m²) | Major Crimp XD (Comparison) XD (g/cm per g/m²) | Major Crimp XD (Comparison) Sum of MD + XD |
|---|---|---|---|---|---|---|---|---|
| 4 | 1.0 | 33.9 | 32.3 | 28.0 | 60.3 | 16.9 | 17.3 | 34.2 |
| | 1.5 | 50.9 | 36.7 | 37.6 | 74.3 | 34.3 | 33.2 | 67.5 |
| | 2.0 | 67.8 | 48.8 | 46.6 | 95.4 | 51.6 | 48.8 | 100.4 |
| 5 | 1.0 | 33.9 | 33.0 | 27.7 | 60.7 | 15.5 | 15.1 | 30.6 |
| | 1.5 | 50.9 | 37.8 | 37.5 | 75.3 | 36.9 | 38.3 | 75.2 |
| | 2.0 | 67.8 | 48.4 | 50.3 | 98.7 | 47.3 | 45.0 | 92.3 |
| 6 | 1.0 | 33.9 | 25.8 | 25.4 | 51.2 | 14.9 | 15.7 | 30.6 |
| | 1.5 | 50.9 | 36.7 | 34.6 | 71.3 | 35.6 | 38.5 | 74.1 |
| | 2.0 | 67.8 | 46.1 | 41.3 | 87.4 | 49.2 | 49.4 | 98.6 |

These experiments show that MD orientation of the major crimp (higher knuckle) wire in the direction of passage of the web beneath the fine columnar streams in the second stage of impingement provides an apertured nonwoven fabric of increased tensile strength in all cases at the web area weight of 1 oz/yd² (33.9 g/m²) and in the case of screens 2, 3, and 4, for the web area weight of 1.5 oz/yd² (50.9 g/m²), although the improvement at this area weight is less than for the lower area weight. A small improvement using screen 3 which was a coarse screen as compared to the other screens for the 2.0 oz/yd² (67.8 g/m²) web is also obtained.

The general procedure of this Example was repeated using a 20 mesh (7.9 wires/cm) plain weave screen (% open area 41 )which was symmetrical in that the crimp of both the warp and shute wires was the same and their knuckles were of the same height. The tensile strength of the fabric prepared on this screen was essentially the same when the warp wires were oriented in the machine direction as when they were oriented in the cross direction of the machine.

EXAMPLE 2

A series of three webs having a nominal area weight of about 1.5 oz/yd² (50.9 g/m²) is prepared from rayon fibers of 1.5 denier per filament and 1⅛ inch (2.9 cm) length, by a known air-laying process. The webs are processed under orifices, at a web-to-orifice spacing or less than 1 inch (2.54 cm), from which orifices, fine columnar water streams having a divergence angle generally less than 1° are jetted. Conditions are selected so that all webs receive an equivalent total hydraulic treatment applied in two separate stages.

SAMPLES A and B

In the first stage of the process, the web is supported on a screen having 100 × 96 wires per inch (39.4 × 37.8 wires per cm), and an open area of 20%. The web on this screen is passed under three manifolds, each of which has a single row of 0.005-inch (0.127 mm) diameter orifices, spaced at 40 orifices/inch (16/cm), to treat the first face of the fabric. Water pressures (gauge) for the three manifolds are:

| manifold | psi | kg/cm² |
|---|---|---|
| 1 | 400 | 28.1 |
| 2 | 800 | 56.2 |
| 3 | 1000 | 70.3 |

In the second stage the web is placed with its treated face adjacent a patterning screen and then treated again with the streams. The screen is a 24 × 24 mesh (9.4 × 9.4 wires/cm) screen having about 21% open area, and woven with flat wires which form the higher knuckles in one screen direction and round wires which form the lower knuckles in the other direction. For sample A, the web is passed with the flat wires running transverse (XD) to the direction of passage under the streams; for sample B, the flat wires are aligned in the direction of passage (MD). Each web is passed under four manifolds, the first three having 0.005-inch (0.127 mm) diameter orifices, spaced 40/inch (15.7/cm) in a single row, and the fourth having the same diameter orifices spaced 60/inch (23.6/cm) in a single row. Water pressures (gauge) are:

| manifold | psi | kg/cm² |
|---|---|---|
| 1 | 500 | 35.2 |
| 2 | 800 | 56.2 |
| 3 | 1800 | 126.5 |
| 4 | 1900 | 133.6 |

Sample C

This sample is processed as in the first stage treatment of Samples A and B, except that the third manifold has two rows of 0.005-inch (0.127 mm) diameter orifices, the orifices being spaced 20/inch (7.9/cm) in each row and the orifices being staggered from row-to-row so that they provide a total coverage of 40 orifices per inch (15.6/cm) of web width. Row-to-row spacing is 0.040 inch (1 mm).

The second stage treatment for Sample C is as for A and B, except that manifolds 2 and 3 are like the two-row manifold just described; and the fourth manifold has two rows of 0.005 inch (0.127 mm) diameter orifices, spaced 30/inch (11.8/cm), to provide a total coverage of 60 orifices per inch of web width (23.6/cm). Row-to-row spacing is 0.040 inch (1 mm). The same patterning screen is used and is arranged with its flat wires in the machine direction (MD). Grab strengths of the samples are given in the following table.

| Sample | Area Weight oz/yd² | Area Weight g/m² | Flat Wire (higher knuckle) | Grab Strength kg MD | Grab Strength kg XD |
|---|---|---|---|---|---|
| A | 1.55 | 52.6 | XD | 5.7 | 4.2 |

-continued

| Sample | Area Weight oz/yd² | Area Weight g/m² | Flat Wire (higher knuckle) | Grab Strength kg MD | Grab Strength kg XD |
|---|---|---|---|---|---|
| B | 1.56 | 52.9 | MD | 6.5 | 4.2 |
| C | 1.56 | 52.9 | MD | 7.2 | 4.4 |

These results show that when the higher knuckle screen wires run in the direction of passage beneath the fine columnar streams of water (Samples B and C), the tensile strength is increased over when the higher knuckle wire runs in the cross direction (Sample A). Use of the two rows of streams (Sample C) instead of just one row (Sample B) gave even a further improvement.

EXAMPLE 3

The experiment using screen 1 of Example 1 is essentialy repeated except for the use of different equipment and that the fibrous web had an area weight of 1.6 oz/yd² (54.2 g/m²) and a different energy profile was used as follows:

| | Gauge pressure kg/cm² First stage | Gauge pressure kg/cm² Second stage |
|---|---|---|
| first pass | 28.1 | 42.2 |
| second pass | 49.2 | 98.4 |
| third pass | 91.4 | 119.5 |
| fourth and fifth pass | 126.5 | 126.5 |
| sixth pass | 133.6 | 126.5 |

The resultant fabric had a grab strength of 17.25 kg (MD) and 9.3 kg (XD) when the higher knuckle wires in the second stage run in the direction of passage beneath the streams as compared to 15.8 kg (MD) and 8.5 kg (XD) when the higher knuckle wires run in the cross direction.

In the Examples, the strip tensile strengths were determined by the cut strip method described in ASTM Test Method D-1117-69 Section 6.1.2 except using a sample length of 3 in. (7.62 cm), an Instron testing machine, a two inch (5.08 cm) gauge length, a rate of elongation of 50%/min and normalizing the test results for variations in sample area weight. Grab strengths were determined using an Instron testing machine and ASTM Method D-1682-69 with a clamping system having 1 × 3 in. (2.54 × 7.62 cm) back face (with the 2.54 om dimension in the pulling direction) and a 1.5 × 1 inch (3.81 × 2.54 cm) front face (with the 3.81 cm dimension in the pulling direction) to provide a clamping area of 2.54 × 2.54 cm. A 4 × 6 in (10.16 × 15.24 cm) sample is tested with its long direction in the pulling direction and mounted between two sets of clamps at a 3-inch (7.62 cm) gauge length (i.e., length of sample between clamped areas).

As many apparently widely different embodiments of this invention may be made without departing from the spirit and scope thereof, it is to be understood that this invention is not limited to the specific embodiments thereof except as defined in the appended claims.

What is claimed is:

1. In the process of impinging fine columnar streams of liquid onto one face of a fibrous web on an apertured support passing beneath said streams and then onto the opposite face of said web on an asymmetrical woven-wire screen passing beneath said streams to produce by fiber entanglement an apertured nonwoven fabric wherein the apertures in said fabric correspond to knuckles in said screen, the improvement comprising carrying out the impingement of said fine columnar streams onto said opposite face of said web wherein the wires forming the higher knuckles in said screen run in the direction of passage of said web beneath said streams and obtaining as a result thereof an apertured nonwoven fabric of increased tensile strength.

2. The process of claim 1 wherein said asymmetrical screen is from 4 to 60 mesh in at least one direction in said screen.

3. The process of claim 1 wherein said web has an area weight of from 0.5 to 2.0 oz/yd².

4. The process of claim 1 wherein said web has an area weight of from 0.5 to 1.7 oz/yd².

5. The process of claim 1 wherein said web has an area weight of from 0.7 to 1.3 oz/yd².

* * * * *